US005082623A

United States Patent [19]

Ekbom

[11] Patent Number: 5,082,623

[45] Date of Patent: Jan. 21, 1992

[54] METHOD OF MANUFACTURING A SPLIT CIRCULAR RING

[75] Inventor: Ragnar Ekbom, Finspang, Sweden

[73] Assignee: ABB Stal AB, Finspang, Sweden

[21] Appl. No.: 531,236

[22] Filed: May 31, 1990

[30] Foreign Application Priority Data

Jun. 1, 1989 [SE] Sweden ..... 89019830

[51] Int. Cl.[5] ..... B22F 7/04

[52] U.S. Cl. ..... 419/8; 419/9; 419/49

[58] Field of Search ..... 419/8, 9, 49

[56] References Cited

U.S. PATENT DOCUMENTS

| | | | |
|---|---|---|---|
| 4,097,276 | 6/1978 | Six | 75/208 R |
| 4,127,684 | 11/1978 | Baker | 427/287 |
| 4,445,259 | 5/1984 | Ekbom | 29/156.8 B |
| 4,526,747 | 7/1985 | Schimmel et al. | 419/8 |
| 4,526,748 | 7/1985 | Rozmus | 419/49 |
| 4,575,327 | 3/1986 | Borchert et al. | 425/78 |
| 4,587,700 | 5/1986 | Gerbishley et al. | 29/156.8 R |
| 4,680,160 | 7/1987 | Helmink | 419/6 |
| 4,855,103 | 8/1989 | Ekbom | 419/26 |

FOREIGN PATENT DOCUMENTS

| | | |
|---|---|---|
| 0002918 | 7/1979 | European Pat. Off. . |
| 0072424 | 2/1983 | European Pat. Off. . |
| 0073651 | 3/1983 | European Pat. Off. . |
| 0086417 | 8/1983 | European Pat. Off. . |
| WO87/05241 | 9/1987 | PCT Int'l Appl. . |

*Primary Examiner*—Stephen J. Lechert, Jr.
*Assistant Examiner*—Nina Bhat
*Attorney, Agent, or Firm*—Leydig, Voit & Mayer

[57] ABSTRACT

A method of preparing a parted circular ring, preferably a vane ring or sealing ring of a turbine, by the ring being hot pressed isostatically in a casing having radial partitions provided therein of the same material as the powder used for the isostatic hot pressing, a coating of release agent being provided at one side of the partitions.

6 Claims, 2 Drawing Sheets

METHOD OF MANUFACTURING A SPLIT CIRCULAR RING

The invention relates to a method in manufacturing a split circular ring, preferably a vane ring or sealing ring of a turbine.

The vane rings of turbines are fixedly mounted in the turbine housing and enclose the turbine shaft in an annular groove therein, a sealing ring (shaft seal or labyrinth seal) being provided to a seal between the vane ring and the bottom of the annular groove. In order that the mounting can be effected it is necessary that the vane ring as well as the sealing ring is split, and usually the vane ring is made in two parts, i.e. it is split along a diametrical plane while the sealing ring is made in four parts, i.e. it is split in two mutually perpendicular diametrical planes. The four parts of the sealing ring are pressed against the bottom of the annular groove in the turbine shaft by helical springs which are received in radial bottom holes in the sealing ring and abut the vane ring. The rings are split by making radial cuts therethrough, which as far as the vane ring is concerned hardly can be effected without at least one cut passes through one of the vanes, which means that the vane has to be repaired, and this is a big job. Moreover, in the method now applied for cutting the vane ring and the sealing ring, a great number of working operations are required which make the manufacture considerably more expensive.

The purpose of the invention is to simplify the manufacture of primarily vane rings and sealings rings of turbines by reducing the number of working operations, and for this purpose the invention provides a method of the kind referred to above, which has obtained according to the invention the features appearing from claim 1.

In order to explain the invention in more detail reference is made to the accompanying drawings in which

BRIEF DESCRIPTION OF THE DRAWINGS

In FIG. 1 there are diagrammatically indicated a turbine housing 10 and a turbine shaft 11, said shaft carrying a blade ring 12. Stationary vane rings 13 fixedly mounted to the turbine housing are provided one at each side of the blade ring 12, said vane rings being received in grooves 14 in the turbine shaft and sealing against the bottom thereof by means of sealing rings 15. A substantially greater number of blade and vane rings are of course provided in a turbine; the only purpose of the diagrammatic figure shown herein is to illustrate the principal arrangement of the rings. The vane rings 13 and the sealing rings 15 must be split in order to be mounted around the turbine shaft 11.

When the method of the invention is applied in order to manufacture the vane ring, said ring is produced by isostatic hot pressing. Referring to FIGS. 2 and 3 the isostatic hot pressing is performed in a casing having an inner cylindrical wall 16 and an outer cylindrical wall 17 and two annular plane endwalls, an upper wall 18 and a lower wall 19, the upper wall being provided with a pipe connection 20 for evacuation of the casing. An annular core 22 of hexagonal boron nitride or graphite, having through apertures 23 corresponding to the vane profile, is supported on a support 21 at the inner side of the lower end wall 19.

Figure 1:
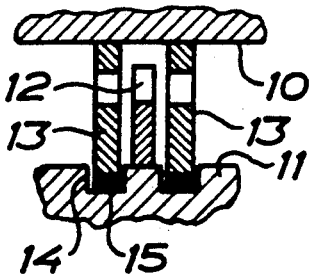
FIG. 1 is a diagrammatic longitudinal cross sectional view which shows the arrangement of the vane rings in a turbine.
Figure 2:
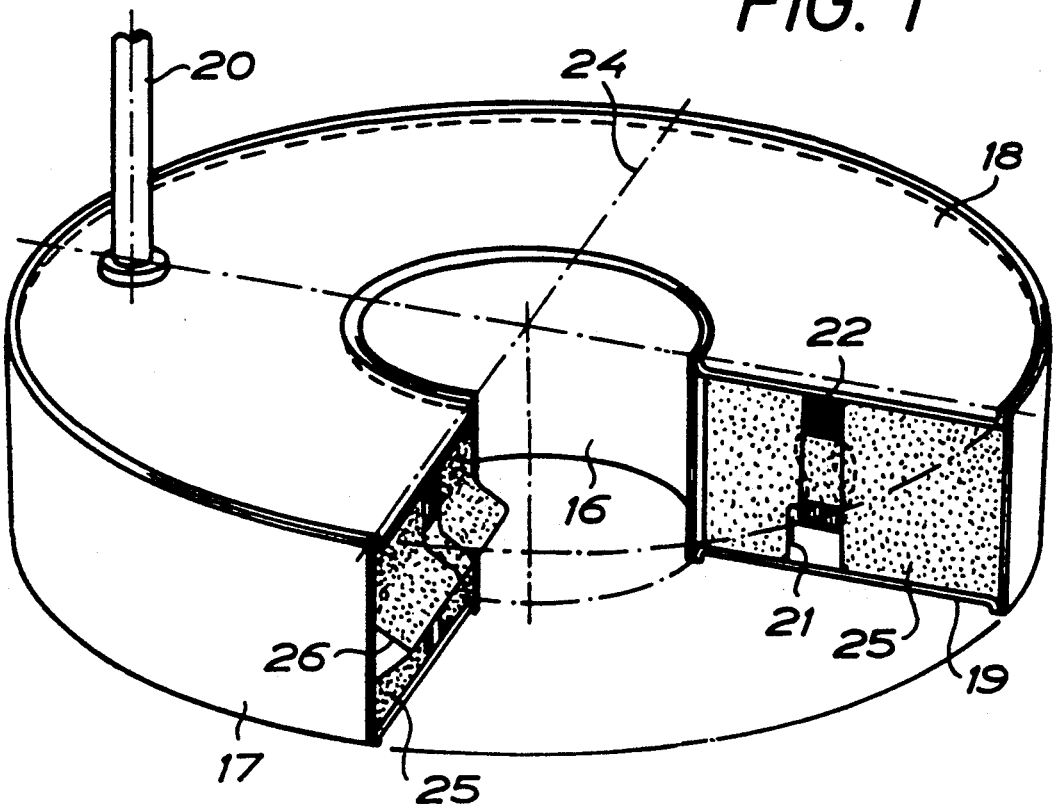
FIG. 2 is a partly cut perspective view of a casing prepared for producing a vane ring by isostatic hot pressing according to the method of the invention.
Figure 3:
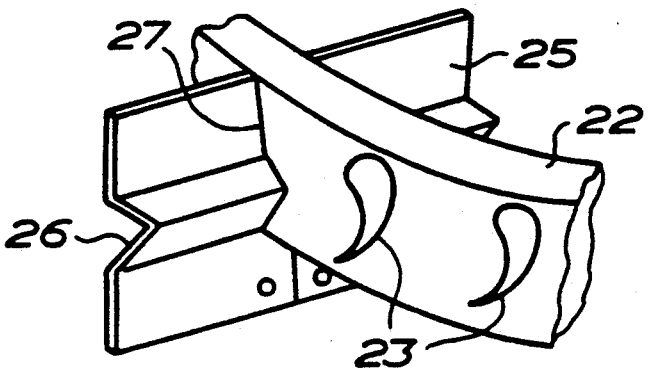
FIG. 3 is a fragmentary perspective view which shows a partition sheet which is used in the casing for isostatic hot pressing, and a core inserted into the casing.
Figure 5:
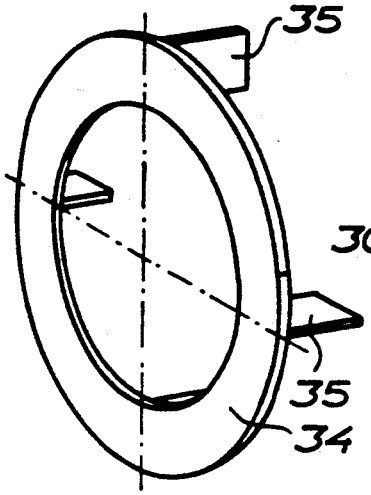
FIG. 5 is a perspective view of a partition ring used in the casing for isostatic hot pressing according to FIG. 4.
Figure 4:
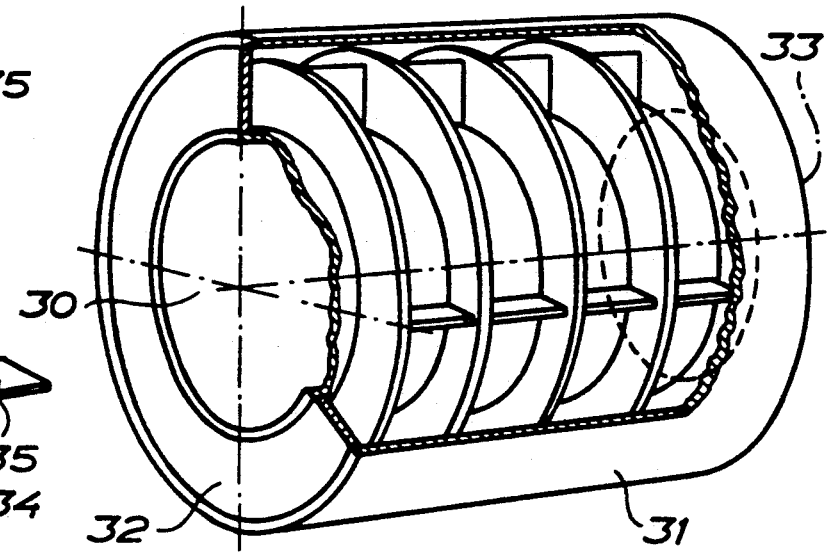
FIG. 4 is a partly cut perspective view of a casing for isostatic hot pressing of sealing rings according to the method of the invention.

Two partitions, one of them being shown at 25, are mounted in a diametrical plane of the casing, which is indicated by a dot and dash line 24. These partitions should have the same cross sectional shape as the casing and should consist of the same kind of sheet as the casing. They form a V-shaped ridge 26, which extends radially across the sheet. The partitions have an aperture 27 to allow passage of the core therethrough. In the present case the core is located adjacent the upper end wall 18, and the aperture for the core then can be formed as a recess in the upper edge of the partition. However, if the core is to be located centrally in the casing it is necessary to split the partition, the two parts thereof being interconnected at the rear side of the partition by means of a joint sheet which is bolted to the two portions of the partition. The partition should have at one side thereof a coating of release agent, e.g. an alumina layer having a thickness 10/μm.

In the manufacture of the vane ring the casing is filled with a metal powder 28 which should be the same metal alloy as that the casing and the partitions are made of, the powder penetrating into the apertures 23 to form the vanes of the vane ring. When the isostatic hot pressing has been performed in the conventional manner, the casing is removed by turning and the core is removed from the isostatically hot pressed body by blasting in the manner proposed in the International application WO 87/05241. The two halves of the vane ring will be separated from each other at the partitions 25 because said halves have a coating of release agent at one side thereof, one interface having a ridge 26 and the other interface having a corresponding groove, so that an accurate matching of the two halves of the vane ring will be facilitated. When mounted in the turbine the two parts can be interconnected by means of bolt connections or by welding.

The manufacture of the sealing ring by applying the method of the invention is illustrated in FIGS. 4–8. A casing for isostatic hot pressing comprises an inner cylindrical wall 30, an outer cylindrical wall 31 and two annular end walls 32 and 33. Connection for evacuation should of course be provided but is not shown herein. Inside the casing a number of annular circular partitions 34 are provided, said partitions having four flanges 35 projecting axially from one side of the partition, said flanges having rectangular shape and being slightly spaced inwardly of the outer and inner circular edges of the partition. The flanges are located in two mutually perpendicular diametrical planes of the partition and are coated with release agent at one side thereof. At the side opposite to the flanges the partition is also coated with release agent. The partitions are located in the casing mutually spaced a distance which is slightly greater than the distance over which the flanges project from the partition, so that the flanges are slightly spaced from the side of the adjacent partition, which is coated with release agent, and it should also be noted that the partitions have an outer diameter which is slightly smaller than the inside diameter of the outer cylindrical wall 30.

Figure 6:
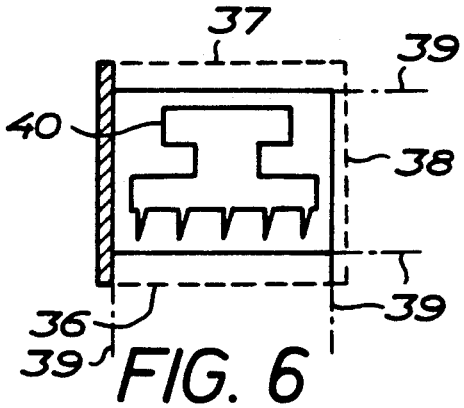
FIG. 6 is a radial cross sectional view of a ring obtained as a blank from the isostatic hot pressing in the casing according to FIG. 4, which is to be processed to form a sealing ring.
Figure 7:
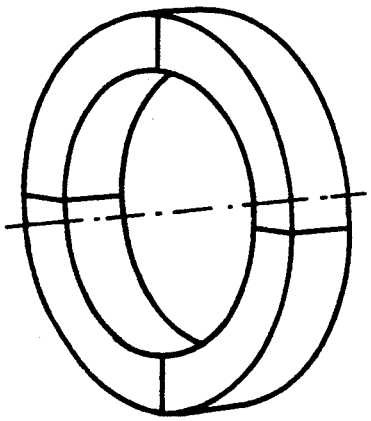
FIG. 7 is a perspective view of the blank ring.
Figure 8:
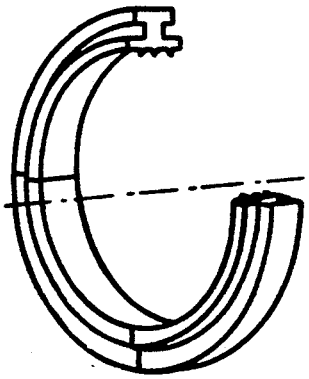
FIG. 8 is a perspective view, partly a cross sectional view, of the sealing ring obtained after processing of the blank ring.

When the casing has been filled with metal powder and the isostatic hot pressing has taken place, a monolithic body has been obtained in which the partitions are embedded. This body can be split into individual rings by being turned at the outside and the inside thereof to the broken lines 36 and 37, which correspond to the inner and outer circular edges of the annular partition 34. Release will take place at the line 38 corresponding to the interface against the surface coated with release agent of the adjacent partition. The ring obtained is in one piece according to FIG. 7. In order that the ring will devide into four equal parts defined by the flanges 35 which form partitions between the parts, the ring must be turned to a profile which is located inwardly of the dot and dash lines 39 in FIG. 6, said profile being defined by the shape of the flanges 35. The ring is turned initially at the outside and the sides thereof and finally at the inside so that the ring during this last turning, which causes the ring to be divided into four parts, can be kept together in a chuck. In FIG. 6 the desired profile of the sealing ring is shown at 40. The finished ring is shown in FIG. 8 where one of the parts is removed.

I claim:

1. A method of preparing a parted circular ring comprising isostatically hot pressing a powder in a casing having radial partitions provided therein, said partitions being of the same material as the powder used during the isostatic hot pressing and having a coating of release agent on one side of the partitions.

2. The method according to claim 1 wherein the body obtained by the isostatic hot pressing is turned to a cross section corresponding to the cross section of the partitions.

3. The method according to claim 1 wherein the radial partitions project axially in a radial plane from an annular partition.

4. The method according to claim 3 wherein the radial partitions terminate at a distance from the inner and outer edges of the annular partition.

5. The method according to claim 4 wherein the body obtained by the isostatic hot pressing initially is turned to the outer and inner diameters of the annular partition and then to a profile which is located inwardly of the edges of the radial partitions.

6. The method according to claim 1 wherein the partitions form a ridge or groove at the side thereof which is coated with release agent.

* * * * *